United States Patent [19]

Masters

[11] 4,407,216

[45] Oct. 4, 1983

[54] FRAME SYSTEM FOR KAYAK

[76] Inventor: William E. Masters, 138 Norris Ave., Liberty, S.C. 29657

[21] Appl. No.: 263,562

[22] Filed: May 14, 1981

[51] Int. Cl.[3] ..... B63B 35/72

[52] U.S. Cl. ..... 114/347; 114/352; 114/363

[58] Field of Search ..... 114/347, 352, 353, 354, 114/357

[56] References Cited

U.S. PATENT DOCUMENTS

| | | | |
|---|---|---|---|
| 215,136 | 5/1879 | Knowles . | |
| 234,164 | 11/1880 | Armstrong | 114/354 |
| 2,346,895 | 4/1944 | Bergman . | |
| 2,406,085 | 8/1946 | Link | 114/354 |
| 2,472,185 | 6/1949 | Ventnor . | |
| 3,076,204 | 2/1963 | Nowak . | |
| 3,099,024 | 7/1963 | Lewis | 114/354 |
| 3,349,415 | 10/1967 | Scholle | 114/352 |
| 3,422,778 | 1/1969 | Halfon . | |
| 3,611,461 | 10/1971 | Wurzberger . | |
| 3,769,645 | 11/1973 | Lettman | 114/363 |
| 3,869,743 | 3/1975 | Brown et al. . | |
| 3,982,293 | 9/1976 | Lagervall . | |
| 4,004,307 | 1/1977 | Hermann . | |
| 4,031,580 | 6/1977 | Neumann et al. | 114/347 |
| 4,167,050 | 9/1979 | Arcouette . | |
| 4,227,272 | 10/1980 | Masters . | |
| 4,229,850 | 10/1980 | Arcouette . | |
| 4,274,170 | 6/1981 | Simpson | 114/347 |

FOREIGN PATENT DOCUMENTS

| | | | |
|---|---|---|---|
| 939645 | 4/1948 | France . | |
| 7323170 | 6/1973 | France . | |
| 1120158 | 7/1968 | United Kingdom . | |
| 1189220 | 4/1970 | United Kingdom | 114/347 |
| 1248351 | 9/1971 | United Kingdom . | |

*Primary Examiner*—Trygve M. Blix
*Assistant Examiner*—Thomas J. Brahan
*Attorney, Agent, or Firm*—Schwartz, Jeffery, Schwaab, Mack, Blumenthal & Koch

[57] ABSTRACT

Longitudinal bow and stern beams are disposed vertically within a kayak hull. A stiffening tube extends beneath the beams. A tube and the beam holder overlaps a lower portion of each beam and rests on the center portion of the stiffening tube for holding the stiffening tube in place and tying the bow and the stern beams together. The holder is maintained in place by a seat which is pressure fit within the cockpit of the kayak. The upper ends of the bow and stern beams are restrained from lateral movement by upper beam holders mounted to the kayak hull. The system allows greater flexure of the kayak hull with less likelihood of the bow and stern beams becoming dislodged.

19 Claims, 7 Drawing Figures

FRAME SYSTEM FOR KAYAK

BACKGROUND OF THE INVENTION

1. Field of the Invention

This invention relates to boats, and in particular to kayaks having frameworks adapted for use in white water sporting activities.

2. Discussion of Related Art

In recent years, the sport of white water boating has gained great popularity. Due to the nature of the sport, special boats which are particularly adapted for use in extreme white water conditions must be used. These boats must be extremely maneuverable, durable and capable of withstanding impact forces developed by contact with rocks, rapidly moving water and the like.

One form of boat which has proved to be particularly popular for white water sports is the kayak. It has been found that extremely suitable kayak hulls can be formed by rotationally molding flexible plastic material, such as high density polyethylene plastic. After the hull is molded, a cockpit opening is cut into the hull. In order to maintain structural integrity of a hull formed in this manner, it is necessary to insert a supporting framework within the hull. Various framework configurations have been suggested for this purpose. For example, as shown in my prior U.S. Pat. No. 4,227,272, the framework can consist of bow and stern framework sections or beams disposed vertically within the hull. Each beam includes an extension which runs into the cockpit area of the hull. A seat is mounted over the extensions to hold the beams in place.

However, conventional frames have been found to be deficient in that the beams used may tend to tip over within the hull of the kayak under extreme conditions. For example, during a broach, when the boat is pinned on a rock in fast moving water, the boat is usually pinned in the center and has a tendency to wrap around the rock resulting in extreme distortion of the boat hull. This distortion can pull the beams from their mounting and the beams can fall over. This results in a dangerous situation in which the kayaker may be trapped within his boat.

SUMMARY OF THE INVENTION

One object of the present invention is to provide a framework system for kayaks that includes beam mountings which reduce the likelihood of the held beams falling laterally within the kayak hull.

A further object of the present invention is to provide a frame system for kayaks which is light in weight yet provides excellent support for the kayak hull in which it is used.

A still further object of the present invention is to provide a frame system for kayaks which may be held within a kayak hull without the use of glue or other material which may become ineffective upon contact with water.

A further object of the present invention is to provide a frame system for kayaks which can be inserted into a kayak hull through a cockpit opening formed in the hull.

A still further object of the present invention is to provide a frame system for kayaks which is capable of absorbing large impact forces.

In accordance with the above and other objects, the present invention comprises a framework to be used in a boat hull, the boat hull having an upper wall and a lower wall extending from a bow portion to a stern portion. The framework includes a first frame member disposed in the bow portion and extending vertically between the upper wall and the lower wall for holding the walls in spaced relation. A second frame member is disposed in the stern portion and extends vertically between the upper wall and the lower wall. An apparatus for longitudinally aligning the first and the second frame members is positioned longitudinally of the hull between the first and the second frame members. A seat is disposed on top of the apparatus.

The frame further includes a tube for stiffening the hull. The tube extends longitudinally of the hull beneath the first frame member, second frame member and the apparatus for aligning the frame members.

The frame members can be in the form of solid expanded foam beams, or, alternatively, can be hollow rotationally molded beams. In either case, the upper portion of each beam is restrained from lateral movement by a mounting means in the form of an upper beam holder having laterally spaced ears which contact opposite sides of the associated beam. The bow beam holder is formed integrally with thigh braces. In this manner, if the kayak were to greatly distort, the kayaker could keep the bow beam upright between his legs and possibly avoid entrapment. The upper stern beam holder is designed such that the distance between the ears is adjustable. Accordingly, the pressure holding the stern beam within the upper stern beam holder can be adjusted.

BRIEF DESCRIPTION OF THE DRAWINGS

The above and other objects of the present invention will become more readily apparent as the invention is more fully described in the detailed description below with reference to the accompanying drawings, in which like reference numerals represent like parts throughout, and in which.

DESCRIPTION OF THE PREFERRED EMBODIMENT

Figure 1:
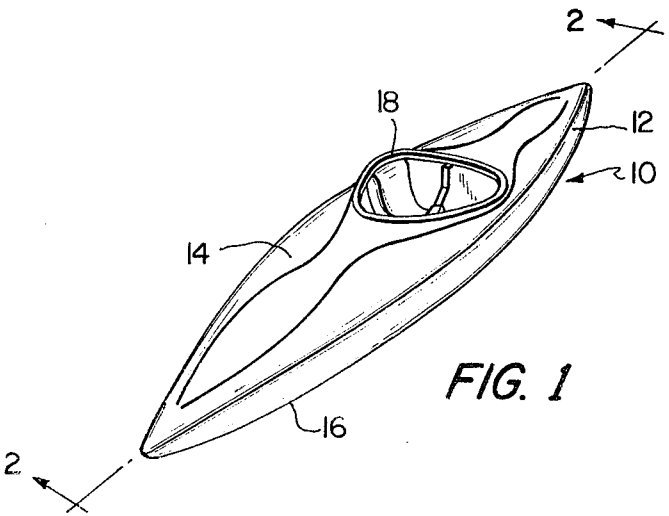
FIG. 1 is a perspective view of a kayak incorporating the frame system of the present invention.
Figure 2:
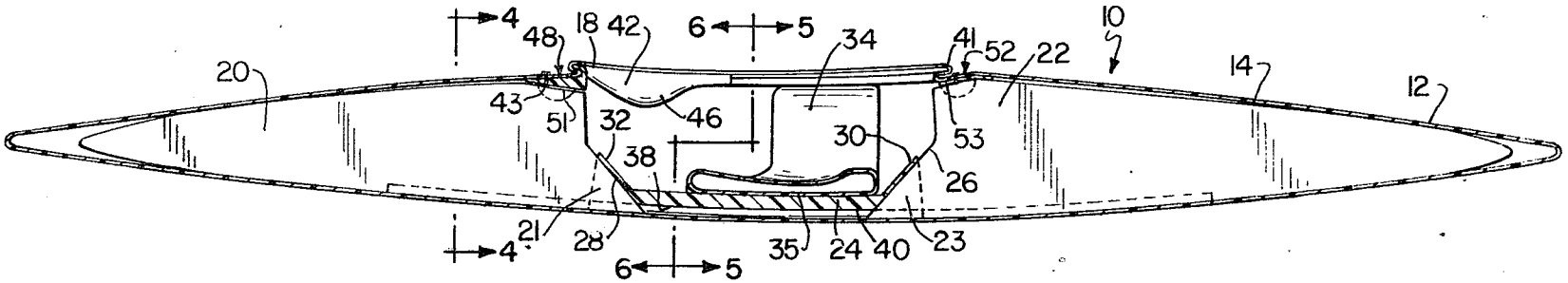
FIG. 2 is a longitudinal sectional view taken substantially along a plane passing through section line 2—2 of FIG. 1 showing the frame system of the present invention.

Now with reference to the drawings, a frame system incorporating the principles and concepts of the present invention will be described in detail. With particular reference to FIGS. 1 and 2, it will be seen that kayak 10 has a hull 12 which comprises an upper wall 14 and a lower wall 16. A cockpit opening 18 is formed centrally of the hull. Hull 12 is preferably formed of high density polyethylene or the like and is rotationally molded such that upper wall 14 and lower wall 16 are unitary. After the hull is molded, cockpit opening 18 is cut into the hull and the frame system is mounted within the interior of hull 12 through cockpit opening 18.

The frame system includes a bow beam 20, a stern beam 22 and a stiffening tube 38 which conforms to the shape of bottom wall 16 and extends along the bottom wall in recesses formed in beams 20 and 22. A beam and tube holder 24 rests on portions of beams 20, 22 and on tube 38 to hold these elements in relatively aligned and interconnected disposition. A seat 34 rests on holder 24 to maintain the elements in a pressurized engagement, as will be discussed hereafter. Further, an upper front beam holder 48 and an upper rear beam holder 52 are mounted to the hull adjacent the cockpit opening for restraining lateral movement of bow beam 20 and stern beam 22, respectively.

Figure 4:
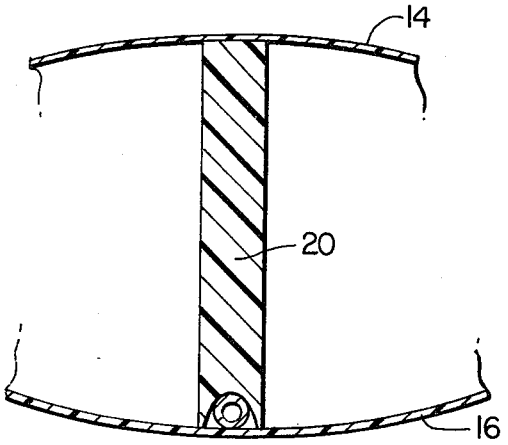
FIG. 4 is a cross-sectional view taken substantially along a plane passing through section line 4—4 of FIG. 2.
Figure 7:
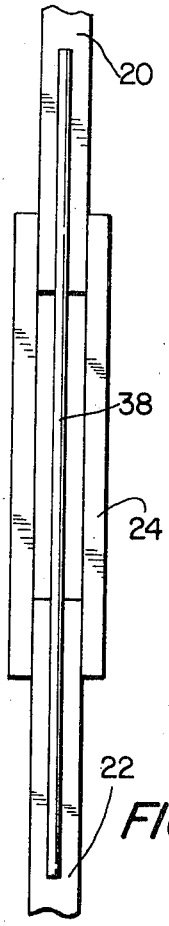
FIG. 7 is a part fragmental bottom view of the frame system of the present invention.
Figure 6:
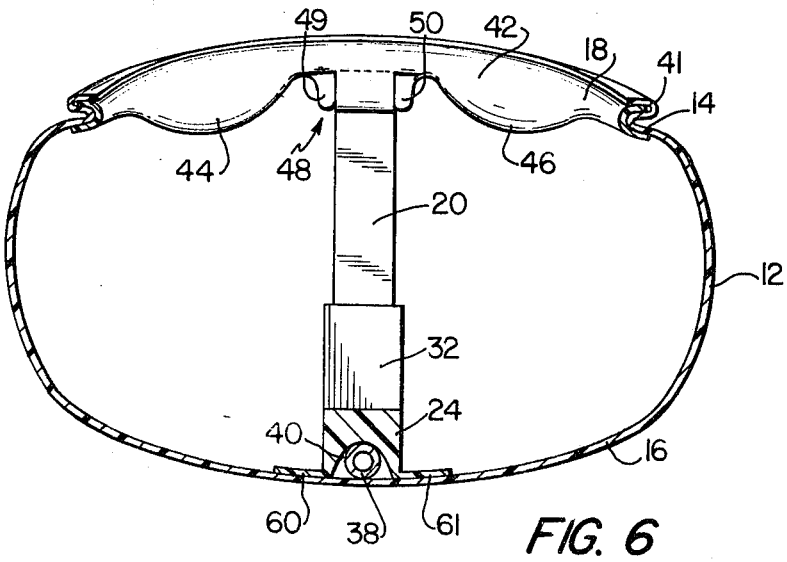
FIG. 6 is a cross-sectional view taken substantially along a plane through section line 6—6 of FIG. 2.

As shown in FIGS. 2, 4 and 6, bow beam 20 is a solid element formed from any suitable expanded foam, such as styrofoam. Beam 20 is substantially rectangular in cross-section and includes an upper surface which follows the contour of upper kayak wall 14. Beam 20 also has a lower surface which follows lower kayak wall 16. Accordingly, beam 20 essentially acts as a wedge to hold the upper and lower walls apart. Beam 20 includes a rearwardly extending portion 21 which is received in holder 24.

Figure 5:
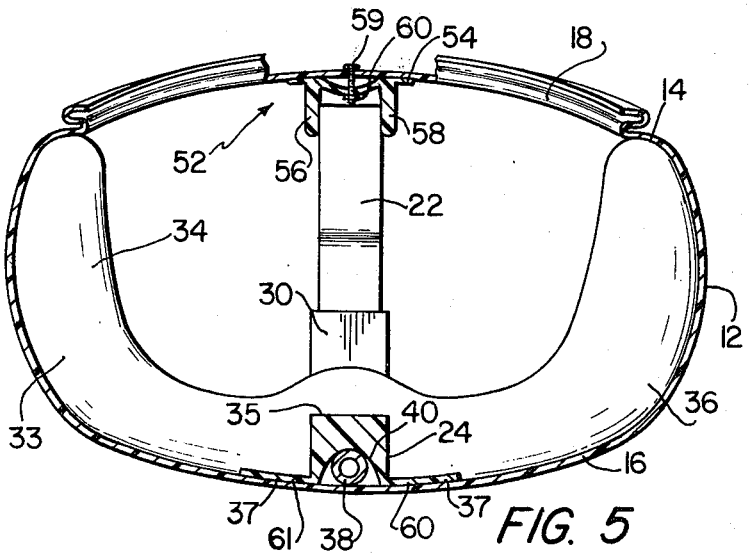
FIG. 5 is a cross-sectional view taken substantially along a plane passing through section line 5—5 of FIG. 2 with portions broken away to show the mounting of the upper rear beam holder.

With reference to FIGS. 2 and 5, it will be seen that stern beam 22 is formed similarly to bow beam 20 and includes upper and lower surfaces which follow upper and lower kayak walls 14 and 16, respectively to hold these walls in spaced relation. Further, stern beam 22 includes a forwardly extending portion 23 which is received in holder 24.

Holder 24, as shown in FIGS. 2 and 4 through 7, is preferably formed from any suitable synthetic resin material. Holder 24 includes a generally elongated body which terminates in oppositely opening recesses formed by upwardly inclined walls 30 and 32, respectively. Walls 30 and 32 mate with the upper surfaces of beam portions 23 and 21, respectively, and thus hold beams 22 and 20 in position in the stern and the bow of kayak 10, respectively. Holder 24 also includes a tube channel 40 which runs longitudinally through the bottom of the holder. Channel 40 receives stiffening tube 38 and holds the stiffening tube in place against the center of bottom wall 16. Tube 38 is preferably formed from fiberglass and is shaped to conform to the contour of bottom wall 16, against which it rests. The tube extends beneath the rear portion of bow beam 20, holder 24, and the forward portion of stern beam 22. The tube provides extra stiffness to the hull 12 to prevent the hull from deforming during periods of extreme force such as during a broach.

Seat 34 rests on the center body of holder 24 and serves to maintain holder 24 in a pressurized engagement with tube 38, bow beam 20 and stern beam 22. Seat 34 is preferably formed from a synthetic resin material and has a hollow interior to aid in absorption of shock. Seat 34 includes an elongated tunnel 35 which is shaped to conform to the outer surface of holder 24 thereby keeping holder 24 located in the lateral center of the kayak as well as forcing holder 24 against the bottom wall 16 of the kayak. As shown most clearly in FIG. 5, seat 34 conforms to the lateral cross-section of hull 12. Seat 34 includes wings 33 and 36 which extend up along the sides of hull 12 and are force fit beneath the upper wall 14 adjacent the sides of cockpit opening 18. When inserted, seat 34 must be flexed to fit through cockpit opening 18. Thereafter, wings 33 and 36 must be forced beneath upper wall 14. It may be necessary to use a hammer or other implement to perform this task. As a result, however, seat 34 serves to provide excellent stabilization for beams 20 and 22, tube 38, and holder 24. No glue or other type adhesive need be used to fix these elements within hull 12.

As seen in FIGS. 2 and 6, an s-curved lip 41 is formed around the cockpit opening 18. This lip receives a portion of an insert 42. Insert 42 curves forward beneath upper wall 14 and follows the upper wall. Insert 42 can be secured to the upper wall by bolts which pass through the insert and upper wall, as shown at 43 in FIG. 2. Insert 42 is formed of any suitable synthetic resin material and contains integrally therein thigh braces 44 and 46 together with front upper beam holder 48.

Beam holder 48 comprises a pair of depending ears 49 and 50 which are positioned on opposite sides of beam 20. The upper surface of beam 20 is inclined downwardly as shown at 51. The surface between ears 49 and 50 is similarly inclined downwardly to mate with surface 51 thus forcing beam 20 forward within the bow of hull 12. Ears 49 and 50 are designed to restrain beam 30 from falling laterally within hull 12. These ears allow the boat to flex and distort under pressure but still keep the bow beam locked in position. It should be noted that the distance between ears 49 and 50 should be such that beam 20 will be slightly compressed when forced between the ears thus limiting the amount of free longitudinal movement the beam can experience.

However, even with beam holder 48 operative, it is possible that the kayak may experience such extreme forces that beam 22 may be pulled from its mounting. For this reason, thigh braces 44 and 46 are molded integrally with beam holder 48 in insert 42. Thigh braces are normally used in a kayak to support a kayaker when performing such manuvers as eskimo rolls or the like. The kayaker's legs are spread out under the deck of a boat and forced against the thigh braces. In the present invention, thigh braces 44 and 46 are positioned directly on opposite sides of beam holder 48. Accordingly, the kayaker's legs are forced directly against beam 20 and, if the kayak were to greatly distort, the kayaker could keep beam 20 upright between his legs and possibly avoid entrapment.

Upper rear beam holder 52 includes a mounting plate or web 54 which, as seen in FIG. 2, slopes downwardly to conform to downwardly sloped surface 53 of stern beam 22. Plate 54 is secured to upper wall 14 of hull 12 by one or more bolts 59 and nuts 60 as shown in FIG. 5. Beam 22 is slightly recessed in the area of nut 60 so as not to interfere with operation of the nut. A pair of ears 56 and 58 are attached to plate 54 on opposite sides of beam 22. The spacing between ears 56 and 58 is dimentioned so that beam 22 must be forced between the ears slightly compressing beam 22. In this manner, beam 22 is held securely within beam holder 52. As seen in FIG. 5, plate 54 bulges downwardly between ears 56 and 58 with nut 60 being positioned at the lowest point on the bulge. Accordingly, the distance between the lowest ends of ears 56 and 58 can be adjusted by tightening bolt 59. When bolt 59 is tightened, nut 60 and the bulge are forced upwardly thereby bending plate 54 to angle ears 56 and 58 inwardly. In this manner, the pressure applied by beam holder 52 to beam 22 easily can be adjusted.

Figure 3:
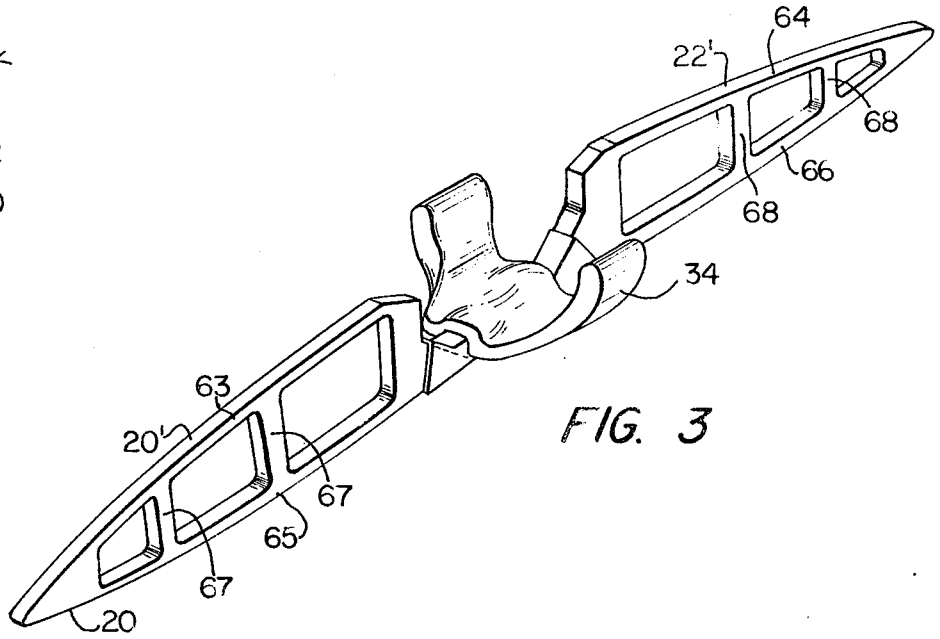
FIG. 3 is a perspective view of an alternate form of the frame system of the present invention.

It should be understood that the frame system of the present invention is designed to absorb shocks encountered while white water boating. The frame system is uniquely adapted to allow kayak 10 to distort slightly to absorb shock while still causing the kayak to maintain structural integrity. In order to more easily absorb shock and to prevent hull 12 from flexing inordinately at any particular point thereby resulting in fatigue failures, it may be desirable to insure that stresses encountered are distributed over a relatively large area. Accordingly, it may be desirable to use flanges such as shown at 60 and 61 in FIGS. 5 and 6 for supporting holder 24. Further, it may be desirable to design beams 20 and 22 as hollow beam elements as set forth in my aforementioned U.S. Pat. No. 4,227,272 and shown in FIG. 3 at 20' and 22'. Beams 20' and 22' comprise upper longitudinal elements 63 and 64, respectively. Elements 63 and 64 are interconnected with lower longitudinal elements 65 and 66 through vertical elements 67 and 68, respectively. Each of the elements 63 through 68 is formed from synthetic resin material and is preferably rotationally molded with a hollow interior. Further, lower longitudinal elements 66 and 67 have arcuate lower surfaces such as shown at 70. These arcuate surfaces are designed to more readily absorb shock from the bottom 16 of the kayak and avoid predetermined flex points which might fatigue the kayak hull. The basic overall configuration of beams 20' and 22' is the same as beams 20 and 22 and beams 20' and 22' fit within the remainder of the frame system in a similar manner.

While several embodiments of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A kayak comprising:

(a) an elongated hull, said hull having a bow portion and a stern portion, and having an upper wall and a lower wall;

(b) a framework disposed within said hull, said framework including: a first frame member disposed in said bow portion and extending substantially between said upper wall and said lower wall; a second frame member disposed in said stern portion and extending substantially between said upper wall and said lower wall;

(c) means for longitudinally aligning said first and said second frame members, said aligning means being positioned generally longitudinally of said hull between said first and second frame members; and (d) seat means disposed on top of said aligning means for holding said aligning means against said lower wall of said hull, wherein said seat means has a longitudinal tunnel formed in the bottom thereof, said aligning means being received in said tunnel in contact with said seat means, said aligning means including portions extending fore and aft of said seat means, said portions having covered recesses contacting, respectively, said first and second frame members for aligning said frame members.

2. The boat as set forth in claim 1 and further including means for stiffening said hull, said stiffening means extending longitudinally along said lower wall beneath said first frame member, said second frame member and said aligning means.

3. The boat as set forth in claim 2 wherein said stiffening means comprises an elongated member.

4. The boat as set forth in claim 1 and further including first mounting means attached to said upper wall for restraining lateral movement of said first frame member.

5. The boat as set forth in claim 4 wherein said first mounting means comprises a pair of laterally spaced depending ears for contacting opposite sides of said first frame member.

6. The boat as set forth in claim 4 and further including thigh brace means for bracing the thighs of a boater, said thigh brace means being formed integrally with said first mounting means.

7. The boat as set forth in claim 4 and further including second mounting means attached to said upper wall for restraining lateral movement of said second frame member.

8. The boat as set forth in claim 7 wherein said second mounting means comprises a pair of laterally spaced ears contacting opposite sides of said first frame member.

9. The boat as set forth in claim 8 and further including means for adjusting the distance between said ears and clamping said second frame member between said ears.

10. The boat as set forth in claim 1 wherein said first and second frame members are hollow.

11. The boat as set forth in claim 1 wherein said seat includes upwardly extending wings positioned beneath said upper wall for holding said seat against said bottom wall.

12. The boat as set forth in claim 1 wherein said first and second frame members are formed from an expanded foam material.

13. A kayak comprising:

an elongated hull, said hull having a bow portion and a stern portion, and having an upper wall and a lower wall;

a framework disposed within said hull, said framework including: a first frame member disposed in said bow portion and extending substantially between said upper wall and said lower wall; a second frame member disposed in said stern portion and extending substantially between said upper wall and said lower wall; a seat; and separate thigh brace means positioned on opposite sides of said first frame member for providing a surface for forcing the legs of an occupant of the kayak against, said thigh brace means including first mounting means comprising a pair of laterally spaced surfaces for contacting opposite sides of said first frame member and inhibiting lateral displacement of said first frame member, said first mounting means being positioned between said thigh brace means.

14. The kayak as set forth in claim 13, wherein said thigh brace means and said first mounting means are formed in a single unitary construction.

15. The kayak as set forth in claim 14, wherein said kayak includes a cockpit opening and said unitary construction includes one edge which conforms generally to an edge portion of said cockpit opening.

16. The kayak as set forth in claim 15, wherein said one edge contains a curved portion which extends over said edge portion of said cockpit opening to assist in locating said unitary construction in said kayak hull.

17. The kayak as set forth in claim 15, wherein said unitary construction includes a second edge which rests against said upper wall at a position spaced forwardly of said cockpit opening.

18. A kayak comprising:

an elongated hull, said hull having a bow portion and a stern portion, and having an upper wall and a lower wall;

a framework disposed within said hull, said framework including: a first frame member disposed in said bow portion and extending substantially between said upper wall and said lower wall; a second frame member disposed in said stern portion and extending substantially between said upper wall and said lower wall;

first mounting means attached to said upper wall to restrain lateral movement of said first frame member; and second mounting means attached to said upper wall for restraining lateral movement of said second frame member;

wherein at least one of said first and second mounting means comprises a pair of laterally spaced projections contacting opposite sides of said restrained frame member, and means for adjusting the distance between said projections, said adjusting means comprising a flexible web connecting said projections, and means for moving said web to different spaced positions relative to said kayak hull upper wall for varying the angle of said projections relative to each other.

19. The kayak as set forth in claim 18, wherein said web is curved downwardly of said hull whereby as said web is bent upwardly, said projections are angled together.

* * * * *